US011041598B2

(12) United States Patent
Albou et al.

(10) Patent No.: US 11,041,598 B2
(45) Date of Patent: Jun. 22, 2021

(54) METHOD AND SYSTEM FOR CONTROLLING THE ELECTRIC CURRENT WITHIN A SEMICONDUCTOR LIGHT SOURCE DEFINING AT LEAST TWO DISTINCT LIGHT-EMISSION REGIONS

(71) Applicant: VALEO VISION, Bobigny (FR)

(72) Inventors: Pierre Albou, Bobigny (FR); Vincent Godbillon, Bobigny (FR)

(73) Assignee: VALEO VISION, Bobigny (FR)

( * ) Notice: Subject to any disclaimer, the term of this patent is extended or adjusted under 35 U.S.C. 154(b) by 0 days.

(21) Appl. No.: 16/609,031

(22) PCT Filed: Apr. 27, 2018

(86) PCT No.: PCT/EP2018/060918
§ 371 (c)(1),
(2) Date: Oct. 28, 2019

(87) PCT Pub. No.: WO2018/197686
PCT Pub. Date: Nov. 1, 2018

(65) Prior Publication Data

US 2020/0149698 A1 May 14, 2020

(30) Foreign Application Priority Data

Apr. 28, 2017 (FR) ..... 1753786

(51) Int. Cl.
*F21S 41/153* (2018.01)
*H05B 45/325* (2020.01)
*H05B 45/10* (2020.01)

(52) U.S. Cl.
CPC ..... *F21S 41/153* (2018.01); *H05B 45/10* (2020.01); *H05B 45/325* (2020.01)

(58) Field of Classification Search
CPC ..... F21S 41/153; F21S 41/155; F21S 41/663; F21S 41/141; H05B 45/325; H05B 45/10
(Continued)

(56) References Cited

U.S. PATENT DOCUMENTS

2007/0247414 A1* 10/2007 Roberts ..... G09F 9/3026 345/102
2011/0204820 A1* 8/2011 Tikkanen ..... H05B 45/60 315/294

(Continued)

FOREIGN PATENT DOCUMENTS

DE 10 2015 013 191 A1 4/2017
DE 10 2015 219 789 A1 4/2017
WO WO 2017/050727 A1 3/2017

OTHER PUBLICATIONS

International Search Report dated Jul. 27, 2018 in PCT/EP2018/060918 filed Apr. 27, 2018.

(Continued)

*Primary Examiner* — Don P Le
(74) *Attorney, Agent, or Firm* — Oblon, McClelland, Maier & Neustadt, L.L.P.

(57) ABSTRACT

A method for controlling an electric current within a semiconductor light source, the light source comprising a substrate with at least two distinct light-emitting regions, wherein the method comprises the following steps: activating a first luminous region, regulating the mean value of the electrical variable relating to the electric current received by the light source as a function of a first setpoint, so as to obtain a first value of a first luminous flux corresponding to the flux emitted by the first luminous region, activating at least a second luminous region of the light source, regulating the mean value of the electrical variable relating to the electric current received by the light source, so as to obtain (Continued)

a second value of a second luminous flux corresponding to the flux emitted by at least the second luminous region.

20 Claims, 3 Drawing Sheets

(58) Field of Classification Search
USPC ..... 315/307
See application file for complete search history.

(56) References Cited

U.S. PATENT DOCUMENTS

2012/0050606 A1* 3/2012 Debevec ..... H05B 45/20 348/370
2012/0280637 A1* 11/2012 Tikkanen ..... H05B 45/37 315/294
2013/0015774 A1* 1/2013 Briggs ..... H05B 45/46 315/186
2013/0093336 A1* 4/2013 St. Jacques ..... H05B 47/10 315/161
2013/0334980 A1* 12/2013 Zhou ..... H05B 45/10 315/250
2014/0175978 A1 6/2014 Kobayashi
2015/0245428 A1 8/2015 Matsumoto et al.
2016/0174341 A1* 6/2016 Kadotani ..... H05B 45/10 315/210
2017/0188433 A1* 6/2017 Chen ..... H05B 45/46
2017/0236982 A1* 8/2017 Akiyama ..... H01L 33/54 315/185 R
2019/0098716 A1* 3/2019 DeJonge ..... H05B 45/44
2019/0098717 A1* 3/2019 Fukuda ..... H05B 45/10
2020/0107425 A1* 4/2020 Zijlman ..... H05B 45/14

OTHER PUBLICATIONS

European Office Action dated Mar. 25, 2021 in European Patent Application No. 18 719 209.1, 9 pages.

* cited by examiner

METHOD AND SYSTEM FOR CONTROLLING THE ELECTRIC CURRENT WITHIN A SEMICONDUCTOR LIGHT SOURCE DEFINING AT LEAST TWO DISTINCT LIGHT-EMISSION REGIONS

The present invention relates to the field of methods and systems for controlling an electric current within a semiconductor light source which incorporates a substrate. Specifically, the present invention relates to a method and a system for controlling an electric current, wherein the system comprises a control component for the mean value of an electrical variable relating to the electric current received by the light source, and a device for the connection of the light source to the control component. Specifically, but not exclusively, the semiconductor light source may comprise a plurality of electroluminescent rods, extending from the substrate. The invention also relates to a lighting unit comprising such a control system, and to a lighting device of a vehicle comprising at least one such lighting unit.

A method for controlling an electric current within a semiconductor light source incorporating a substrate, which permits the modification of the luminous flux from the light source, is known. The method is deployed by a control system comprising a control component for the mean value of an electrical variable relating to the electric current received by the light source, and a device for the connection of the light source to the control component. The electrical variable is, for example, the voltage, intensity or electric power of the electric current. A method of this type comprises a step for the regulation, by means of the control component, of the mean value of the electrical variable relating to the electric current received by the light source as a function of a setpoint for the mean current, electric voltage or electric power. The setpoint for the mean current, electric voltage or electric power thus corresponds to the desired luminous flux for the light source.

However, a drawback of a method of this type for controlling a current is that it does not permit the achievement of a high dynamic luminous flux. In practice, the control component is generally a chopper connected to a switched-mode power supply, and the control executed by the chopper is control of the pulse-width modulation type. However, the minimum duty cycle for this control, which must not be undershot if the accuracy of current control is not to be severely impaired, generally lies between 5 and 7%. More specifically, if the duty cycle applied during this control by pulse-width modulation is less than the value of 5%, "soft" wave fronts may occur in the control characteristic of the electrical variable relating to the electric current received by the light source. "Soft" wave fronts of this type, which may even result in triangular wave crenellation rather than the recommended rectangular crenellation, impair the accuracy of current control, and are associated with substantial losses of efficiency, or even problems of electromagnetic compatibility within the system. In practice, tolerance in the pulse width is absolute, and is not dependent upon said width. In other words, where this width decreases, the relative tolerance is increasingly greater.

This is particularly problematic where the light source is intended for use in a plurality of functions, each of which features a distinct luminous flux value, and where the ratio between the extreme flux values is specifically equal to or greater than 20. In this case, in practice, the minimum duty cycle which should be applied during control by pulse-width modulation for the achievement of a given dynamic flux should be equal to or lower than 5%. A situation of this type is known, for example, in the field of vehicles, where the light source is intended to be employed for the execution of both a "daytime running light" function and a "position light" function.

In order to overcome the above-mentioned drawback, a known solution involves the addition of a resistor to the above-mentioned control system, and the series connection of said resistor to the light source, the current of which is to be controlled. The rating of this resistor is selected in order to permit the thermal dissipation of energy associated with "soft" wave fronts. However, a solution of this type is extremely expensive, on the grounds of the cost of such a resistor. Moreover, a resistor of this type does not permit an improvement in the accuracy of current control.

The technical issue which the invention is intended to resolve is therefore the proposal of a method and system for controlling an electric current within a semiconductor light source incorporating a substrate, which permits an increase in the dynamic flux of the source, specifically the achievement of a ratio between the extreme flux values equal to or greater than 100, in a simple manner, at low cost, and with no loss of efficiency or electromagnetic disturbance within the system.

To this end, a first object of the invention is a method for controlling an electric current within a semiconductor light source, said light source comprising a substrate, wherein said light source defines, on its substrate, at least two distinct light-emitting regions, wherein said method is deployed by a system for controlling the electric current within the light source, said control system comprising a control component for the mean value of an electrical variable relating to the electric current received by the light source, wherein said control component is designed to be connected to an electric current or an electric voltage input source, specifically for a direct current or direct voltage input, said control system further comprising a device for the connection of the light source to the control component, wherein said connection device is associated with distinct light-emitting regions of the light source, and is designed to execute the selective activation of said light-emitting regions, wherein the method comprises the following steps:

- activating a first luminous region of the light source,
- regulating, by means of the control component, the mean value of the electrical variable relating to the electric current received by the light source as a function of a first setpoint for the mean current, electric voltage or electric power, so as to obtain a first value of a first luminous flux for the light source, wherein said first luminous flux corresponds to the flux emitted by said first luminous region,
- activating at least a second luminous region of the light source,
- regulating, by means of the control component, the mean value of the electrical variable relating to the electric current received by the light source as a function of a second setpoint for the mean current, electric voltage or electric power, so as to obtain a second value of a second luminous flux for the light source, wherein said second luminous flux corresponds to the flux emitted by at least said second luminous region.

Due to the fact that the light source defines, on its substrate, at least two selectively activatable light-emitting regions, it is possible to execute the separate and independent regulation, by means of the control component, of the respective luminous flux values associated with each of the light-emitting regions. It is thus possible, by means of this control, and by the selective addition or activation of luminous regions, to obtain a broader range for the regulation of the luminous flux, without sacrificing the accuracy of current control, nor generating any problems of efficiency or electromagnetic compatibility within the system. Moreover, this increase in the range of regulation of potential values for the luminous flux is achieved with no modification of other physical characteristics of the light source, such as color, for example. Moreover, the control method according to the invention involves the deployment of one control component only, wherein said component is a conventional control component. Accordingly, the control method according to the invention permits an increase in the dynamic flux of the light source, in a simple manner, at low cost, with no loss of efficiency or electromagnetic disturbance in the system.

The control method according to the invention can optionally incorporate one or more of the following characteristics:

the control component is a chopper, and the control executed by the chopper is control of the pulse-width modulation type; this permits a further increase in the dynamic flux of the light source, or the simplification of the structure of the light source for a given dynamic luminous flux;

at least two of the light-emitting regions are concentric regions; this permits the achievement of a variable dynamic flux as a function of the region considered on the light source; it is thus possible, using a single lighting unit equipped with a single optical module, to execute a plurality of photometric functions with highly diverse intensity values, and also with different distributions;

the light source defines, on its substrate, three distinct light-emitting regions, wherein a first light-emitting region is surrounded by a second light-emitting region, the second light-emitting region is surrounded by a third light-emitting region, and the method further comprises a step for activating the third luminous region, and a step for regulating, by means of the control component, the mean value of the electrical variable relating to the electric current received by the light source as a function of a third setpoint for the mean current, electric voltage or electric power, so as to obtain a third value for a third luminous flux of the light source, wherein said third luminous flux corresponds to the flux emitted by at least the third luminous region;

during the control steps, the control component regulates the mean value of the electrical variable relating to the electric current received by the light source, such that the ratio between the second value of the second luminous flux obtained at the end of the second control step and the first value of the first luminous flux obtained at the end of the first control step is equal to or greater than 3, and preferably lies between 3 and 30; and such that the ratio between the third value of the third luminous flux obtained at the end of the third control step and the second value of the second luminous flux obtained at the end of the second control step is equal to or greater than 4, and preferably lies between 4 and 100;

the first value of the first luminous flux obtained for the light source and the second value of the second luminous flux obtained for the light source are such that the ratio between the second value of the second luminous flux and the first value of the first luminous flux is equal to or greater than 100, and preferably lies between 100 and 1,000;

during the control step for the mean value of the electrical variable relating to the electric current received by the light source as a function of a second setpoint for the mean current, electric voltage or electric power, the second luminous flux obtained corresponds to the flux emitted by said first luminous region and by said second luminous region;

the control system further comprises a measuring component for a representative electrical variable of a current flowing in the light source, wherein the control component is connected to the measuring component, wherein said method further comprises a step for measuring a representative electrical variable of the electric current flowing in the light source, and a step for the delivery of at least one element of measuring data for said electrical variable, and wherein each step for the control of the mean value of the electrical variable relating to the electric current received by the light source constitutes a regulation of said mean value, executed as a function of said measuring data and a first, or respectively a second, setpoint for the mean current, electric voltage or electric power; this permits an improvement in the accuracy of the control of the mean value of the electrical variable relating to the electric current received by the light source, in comparison with an open-circuit device.

A further object of the invention is a system for controlling an electric current within a semiconductor light source, said light source comprising a substrate, wherein said light source defines, on its substrate, at least two distinct light-emitting regions, the system being designed for the deployment of the above-mentioned method for controlling an electric current, wherein the system comprises a control component for the mean value of an electrical variable relating to the electric current received by the light source, and a device for the connection of the light source to the control component, wherein said connection device is associated with distinct light-emitting regions of the light source, and is designed for the selective activation of said light-emitting regions; the control component is designed to be connected to an electric current or an electric voltage input source, specifically for a direct current or direct voltage input, and is configured to regulate, for each luminous region activated, the mean value of the electrical variable relating to the electric current received by the light source as a function of a setpoint for the mean current, electric voltage or electric power associated with said activation.

The control system according to the invention can optionally incorporate one or more of the following characteristics:

the control system is integrated in the light source;

the control component is a chopper, wherein said chopper is designed to execute a control of the pulse-width modulation type; this permits a further increase in the dynamic flux of the light source, or the simplification of the structure of the light source for a given dynamic flux;

the connection device comprises an electronic semiconductor switching component, such as a transistor, wherein said electronic component comprises two conduction electrodes and a control electrode, wherein said control electrode is designed to receive a command signal for the activation of one of said light-emitting regions;

the control system further comprises a measuring component for a representative electrical variable of a current flowing in the light source, wherein the measuring component is designed to deliver at least one element of measuring data for said electrical variable; the control component is connected to the measuring component, and is configured to regulate, for each luminous region activated, the mean value of the electrical variable relating to the electric current received by the light source as a function of the value of the measuring data and of a setpoint for the mean current, electric voltage or electric power associated with said activation; this permits an improvement in the accuracy of the regulation of the mean value of the electrical variable relating to the electric current received by the light source, in comparison with an open-circuit device.

A further object of the invention is a lighting unit comprising a semiconductor light source and a system for controlling an electric current within the light source, wherein said light source comprises a substrate and defines, on its substrate, at least two distinct light-emitting regions, in which the system for controlling the electric current is as described above.

The lighting unit according to the invention can optionally incorporate one or more of the following characteristics:

- the light source further comprises a plurality of electroluminescent rods, extending from the substrate;
- each electroluminescent rod has dimensions in the submillimeter range;
- each electroluminescent rod extends in a preferred direction from the substrate;
- the electroluminescent rods extend in the same preferred direction from the substrate;
- the electroluminescent rods are divided into a plurality of separate groups of rods, wherein each group of rods corresponds to all or part of one of said light-emitting regions;
- for each group of rods, the rods in said group are mutually electrically interconnected;
- for each group of rods, the rods in said group are electrically connected in parallel.

According to a further form of embodiment, the lighting unit according to the invention can optionally incorporate one or more of the following characteristics:

- the light source further comprises a plurality of electroluminescent studs, extending from the substrate;
- each electroluminescent stud has dimensions in the submillimeter range;
- each electroluminescent stud extends in a preferred direction from the substrate;
- the electroluminescent studs extend in the same preferred direction from the substrate;
- the electroluminescent studs are divided into a plurality of separate groups of studs, wherein each group of studs corresponds to all or part of one of said light-emitting regions;
- for each group of studs, the studs in said group are mutually electrically interconnected;
- for each group of studs, the studs in said group are electrically connected in parallel.

According to a preferred form of embodiment of the invention, the light source comprises a plurality of photoemitter elements, wherein the photoemitter elements are divided into a plurality of separate groups of photoemitter elements, wherein each group of photoemitter elements corresponds to one of said luminous regions, wherein the photoemitter elements in the groups corresponding to said at least two light-emitting regions are interlaced such that said groups of photoemitter elements constitute interlaced matrices of discrete photoemitter elements.

This preferred form of embodiment of the invention advantageously permits the conservation of a virtually uniform aspect in the visual appearance of the light source, regardless of the value of the luminous flux emitted by said source.

According to a further particular form of embodiment of the invention, said at least two light-emitting regions of the light source are concentric regions.

The lighting unit according to this particular form of embodiment of the invention can optionally incorporate one or more of the following characteristics:

- the light source defines, on its substrate, a first light-emitting region, and a second light-emitting region, which is distinct from the first region and which surrounds the first region, wherein the surface area of the second light-emitting region is greater than that of the first light-emitting region, for example such that the ratio between the surface area thereof and the surface area of the first light-emitting region is equal to or greater than 9, and is preferably equal to or greater than 10;
- the light source defines, on its substrate, a first light-emitting region, and a second light-emitting region, which is distinct from the first region and which surrounds the first region, wherein the density of the electroluminescent rods in the group corresponding to the second light-emitting region is greater than that in the first light-emitting region, for example such that the ratio between the density thereof and the density of the electroluminescent rods in the group corresponding to the first light-emitting region is equal to or greater than 9, and is preferably equal to or greater than 10;
- the light source is a high-definition light source;
- the control system is integrated in the light source.

A further object of the invention is a lighting device of a vehicle comprising at least one lighting unit of the type described above.

In a particular form of embodiment of the invention, the lighting device of the vehicle according to the invention is a carriageway lighting device, specifically a floodlight, or a signaling device, specifically an indicator light, or a lighting device for a vehicle passenger compartment.

A further object of the invention is a vehicle comprising at least one lighting device for a vehicle, as described above.

Further characteristics and advantages of the invention will emerge from the following detailed description of non-limiting examples, for the clarification of which reference shall be made to the attached drawings, in which.

Figure 1:
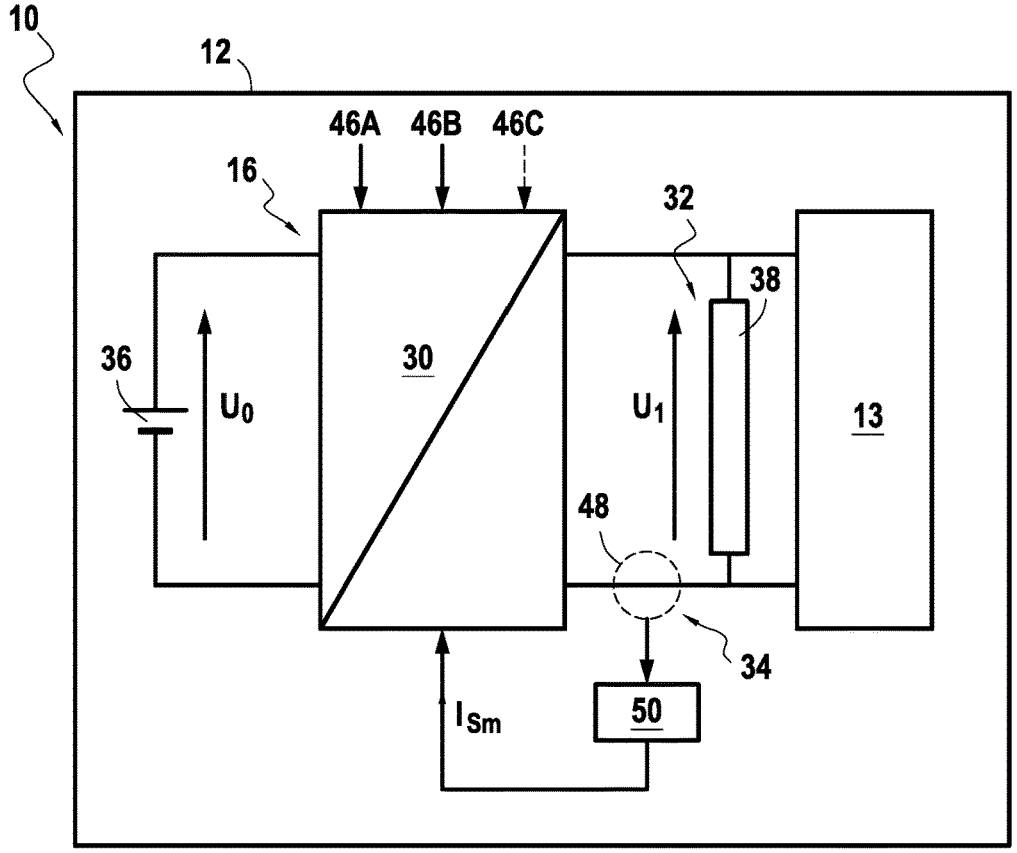
FIG. 1 shows a schematic representation of a lighting device for a vehicle equipped with a lighting unit, wherein the lighting unit comprises a light source and a system for controlling an electric current according to the invention.

FIG. 1 illustrates a lighting device 10 for a vehicle, comprising a lighting unit 12. The lighting device 10 is, for example, a carriageway lighting device, specifically a floodlight. In an unrepresented variant, the lighting device 10 is a signaling device, specifically an indicator light. In a further unrepresented variant, the lighting device 10 is a lighting device for a vehicle passenger compartment.

The lighting unit 12 comprises a semiconductor light source 13, and a system 16 for controlling an electric current within the light source 13. The lighting unit 12 further comprises an optical module, wherein such a module is not represented on the figures, in the interests of clarity.

Figure 2:
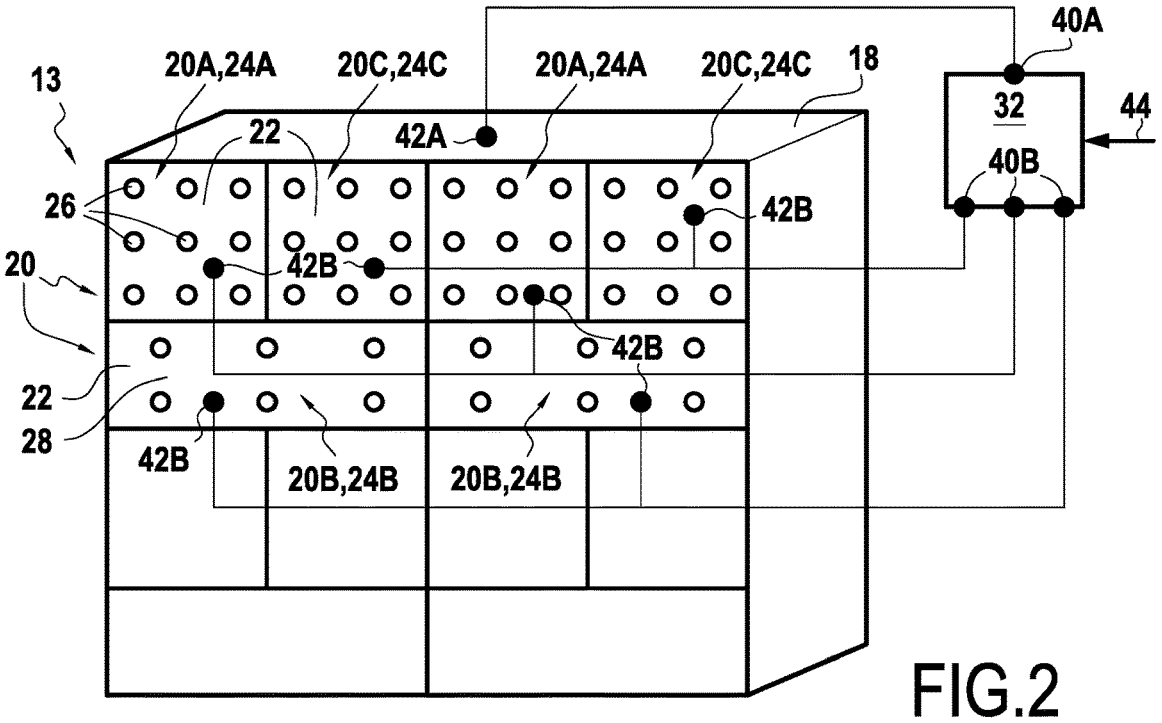
FIG. 2 shows a perspective view of the light source from FIG. 1, according to a first form of embodiment.
Figure 3:
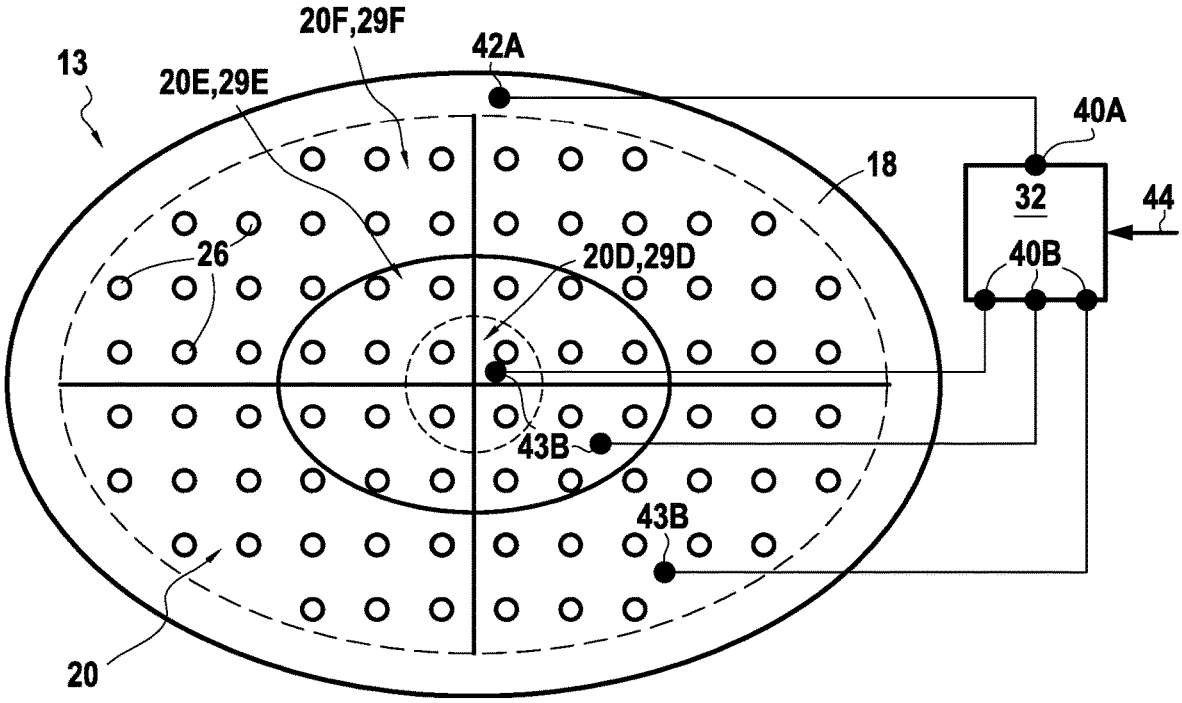
FIG. 3 shows an analogous view to that represented in FIG. 2, according to a second form of embodiment of the light source.

As illustrated in FIGS. 2 and 3, the light source 13 comprises a substrate 18 and defines, on its substrate 18, at least two distinct light-emitting regions 20. The substrate 18 is, for example, essentially comprised of silicon.

In the preferred form of embodiment represented in FIG. 2, the light source 13 further comprises a plurality of photoemitter elements 22. The photoemitter elements 22 are divided into a plurality of distinct groups 24A, 24B, 24C of photoemitter elements. Each group 24A, 24B, 24C of photoemitter elements 22 corresponds to one of the distinct light-emitting regions 20. Accordingly, in the particular form of embodiment illustrated in FIG. 2, the photoemitter elements 22 are divided into three distinct groups 24A, 24B, 24C of photoemitter elements, and the light source 13 defines, on its substrate 18, three corresponding light-emitting regions 20A, 20B, 20C.

As illustrated in FIG. 2, the photoemitter elements 22 in groups 24A, 24B, 24C are interlaced such that said groups 24A, 24B, 24C of photoemitter elements constitute interlaced matrices of discrete photoemitter elements 22. A "matrix of discrete photoemitter elements" is to be understood as a network of interconnected photoemitter elements which constitute a group of discrete photoemitter elements, whether or not this network assumes a regular form.

Preferably each photoemitter element 22 comprises at least one electroluminescent rod 26. In a particular exemplary embodiment illustrated in FIG. 2, each photoemitter element comprises at least one electroluminescent rod 26 and one photoluminescent element 28. Preferably, each photoemitter element 22 comprises a plurality of electroluminescent rods 26 and one photoluminescent element 28. The electroluminescent rods 26 are thus divided into a plurality of groups of electroluminescent rods 26 wherein, in this case, each group corresponds to one photoemitter element 22. Preferably, the electroluminescent rods 26 within the same photoemitter element 22 are mutually electrically interconnected. Further preferably, electroluminescent rods 26 within the same photoemitter element 22 are electrically connected in parallel.

Each electroluminescent rod 26 extends from the substrate 18. Preferably, each electroluminescent rod 26 has dimensions in the sub-millimeter range. Each electroluminescent rod 26 extends, for example, in a preferred direction from the substrate 18. Preferably, the electroluminescent rods 26 of the light source 13 extend in the same preferred direction from the substrate 18. Each electroluminescent rod 26 is comprised, for example, of a metal nitride, specifically gallium nitride.

Each photoluminescent element 28 is formed, for example, of a layer of photoluminescent material. Each photoluminescent element 28 describes a light converter comprising at least one luminescent material which is designed to absorb at least a proportion of at least one excitation light emitted by a light source and to convert at least a proportion of said absorbed excitation light into an emitted light having a wavelength which differs from that of the excitation light. In the case of a yellow light, the material of the photoluminescent element is, for example, one of the following compounds: $Y_3A_{15}O_{12}:Ce^{3+}$ (YAG), $(Sr,Ba)_2SiO_4:Eu^{2+}$, $Ca_x(Si,Al)_{12}(O,N)_{16}:Eu^{2+}$ As a variant of the particular form of embodiment illustrated in FIG. 2, the light source 13 is a two-dimensional monolithic source, for example of the two-dimensional monolithic electroluminescent diode type, and each photoemitter element 22 is an element of said monolithic source. The photoemitter elements are divided into a plurality of distinct groups of photoemitter elements on this source, wherein each group corresponds to one of the distinct light-emitting regions. The constituent photoemitter elements of groups are interlaced such that said groups of photoemitter elements constitute interlaced matrices of discrete photoemitter elements. This applies where the photoemitter elements assume the form of a stud. In one exemplary embodiment, light is emitted at the tip of the studs.

FIG. 3 represents the light source 13, according to a second form of embodiment, as an alternative to the form of embodiment illustrated in FIG. 2. In this second form of embodiment, the light source 13 defines, on its substrate 18, a plurality of concentric light-emitting regions 20D, 20E, 20F. In the particular exemplary embodiment illustrated in FIG. 3, the light source 13 defines, on its substrate 18, three concentric light-emitting regions: a first light-emitting region 20D, a second light-emitting region 20E which surrounds the first region 20D, and a third light-emitting region 20F which surrounds the second region 20E. For example, where the first light-emitting region 20D is activated, the light source 13 is employed in the vehicle in accordance with a "position light" function; where at least the second luminous region 20E is activated, the light source 13 is employed in the vehicle in accordance with a "daytime running light" function; and where at least the third luminous region 20F is activated, the light source 13 is employed in the vehicle in accordance with a "main-beam headlamp" function.

Preferably, as illustrated in FIG. 3, the light source comprises a plurality of electroluminescent rods 26. The electroluminescent rods 26 are thus divided into a plurality of groups 29D, 29E, 29F of electroluminescent rods 26, wherein each group corresponds to one of the light-emitting regions 20D, 20E, 20F. Preferably, the electroluminescent rods 26 in a given group 29D, 29E, 29F are mutually electrically interconnected. Further preferably, the electroluminescent rods 26 in a given group 29D, 29E, 29F are electrically connected in parallel.

Each electroluminescent rod 26 extends from the substrate 18. Preferably, each electroluminescent rod 26 has dimensions in the sub-millimeter range. Each electroluminescent rod 26 extends, for example, in a preferred direction from the substrate 18. Preferably, the electroluminescent rods 26 of the light source 13 extend in the same preferred direction from the substrate 18. Each electroluminescent rod 26 is comprised, for example, of a metal nitride, specifically a gallium nitride.

As a variant of the particular exemplary embodiment illustrated in FIG. 3, the light source 13 according to this second form of embodiment is a high-definition light source. A "high-definition light source" is understood as a light source comprising a high number, typically equal to or greater than 1,000, of electroluminescent elements, which are capable of being supplied separately.

As a further variant, the light source 13 according to this second form of embodiment defines, on its substrate, two concentric light-emitting regions: a first light-emitting region, and a second light-emitting region which surrounds the first region. Preferably, according to this exemplary embodiment, the surface area of the second light-emitting region is greater than that of the first light-emitting region, for example such that the ratio between said surface area and the surface area of the first light-emitting region is equal to or greater than 9, and is preferably equal to or greater than 10. Alternatively or additionally, where the light source 13 further comprises a plurality of electroluminescent rods divided into groups of rods, the density of electroluminescent rods in the group corresponding to the second light-emitting region is greater than that of the group corresponding to the first light-emitting region, for example such that the ratio between said density and the density of electroluminescent rods in the group corresponding to the first light-emitting region is equal to or greater than 9, and is preferably equal to or greater than 10.

Returning to FIG. 1, the control system 16 comprises a control component 30 for the mean value of an electrical variable relating to the electric current received by the light source 13, and a device 32 for the connection of the light source 13 to the control component 30. Preferably, the control system 16 further comprises a measuring component 34 for an electrical variable relating to an electric current flowing in the light source 13.

The connection device 32 is linked to distinct light-emitting regions 20 of the light source 13, and is designed for the selective activation of said light-emitting regions 20, as illustrated in FIGS. 2 and 3.

As represented in FIG. 1, the connection device 32 comprises, for example, an electronic semiconductor switching component 38 such as, for example, a transistor. The electronic component 38 comprises two conduction electrodes and one control electrode, which are not represented in the figures, in the interests of clarity. One of the conduction electrodes constitutes, for example, a negative terminal 40A. The other conduction electrode is, for example, suitable for connection to one or more positive terminals 40B. In the forms of embodiment of the light source 13 illustrated in FIGS. 2 and 3, the negative terminal 40A is connected to a cathode 42A arranged on the substrate 18. In the form of embodiment illustrated in FIG. 2, each positive terminal 40B is connected to anodes 42B which are associated with one group 24A, 24B, 24C of photoemitter elements, wherein each anode 42B is arranged on a photoemitter element 22. More specifically, each anode 42B is, for example, formed by a conductive layer which is deposited on top of the substrate 18, to the side of the rods 26 of the photoemitter element 22 on which the anode 42B is arranged. Preferably, each anode 42B electrically connects the rods 26 of the photoemitter element 22 on which it is arranged. In the form of embodiment illustrated in FIG. 3, each positive terminal 40B is connected to an anode 43B arranged within a group 29D, 29E, 29F of electroluminescent rods 26. More specifically, each anode 43B is, for example, formed by a conductive layer which is deposited on top of the substrate 18, to the side of the rods 26 of the group 29D, 29E, 29F within which the anode 43B is arranged. Preferably, each anode 43B electrically interconnects the rods 26 of the group 29D, 29E, 29F within which it is arranged.

The control electrode is suitable for receiving a command signal 44 for the activation of one of the light-emitting regions 20.

The control component 30 is connected to an electric current or an electric voltage input source 36, specifically for a direct current or direct voltage input. The power source 36 is, for example, arranged within the lighting unit 12. As a variant, the power source 36 is arranged within the vehicle and constitutes, for example, the vehicle battery. In this case, the power source 36 is, for example, connected via a distributor, which is also situated within the vehicle. In the particular exemplary embodiment illustrated in FIG. 1, the power source 36 is a direct electric voltage input source, which delivers a substantially constant electric input voltage $U_0$.

The control component 30 is configured for the regulation, in each activated luminous region 20, of the mean value of the electrical variable relating to the electric current received by the light source 13, as a function of a setpoint 46A, 46B, 46C for the mean current, electric voltage or electric power associated with this activation. The setpoint 46A, 46B, 46C for the mean current, electric voltage or electric power is, for example, saved in an internal or external memory of the lighting device 10, which is not represented in the figures. The setpoint 46A, 46B, 46C can be updated dynamically in the memory, specifically as a function of temperature, by a control module connected to the memory. A control module of this type is not represented in the figures, in the interests of clarity.

In a preferred exemplary embodiment illustrated in FIG. 1, the control component 30 is a chopper which is designed to deliver an electric current output for circulation within the light source 13. According to this preferred exemplary embodiment, the electrical variable to be controlled is the electric voltage, and the control component 30 is configured to regulate the mean value of the output voltage U1 as a function of a setpoint 46A, 46B, 46C for the mean current. Preferably, the chopper which constitutes the control component 30 has a chopping frequency which ranges from 50 Hz to 1 kHz, preferably from 200 Hz to 1 kHz, such that oscillations will not be perceptible to the human eye, and further preferably is substantially equal to 400 Hz.

According to the particular exemplary embodiment illustrated in FIG. 1, the control system 16 deploys a power supply voltage and a current control function for the light source 13.

The measuring component 34 is connected to the control component 30. The measuring component 34 is capable of delivering at least one element of measuring data Ism for an electrical variable relating to the electric current received by the light source 13. According to the particular exemplary embodiment in FIG. 1, the electrical variable measured is an electric current, and the measuring component 34 is capable of delivering measuring data Ism for the mean value of the electric current received by the light source 13. The control component 30 is thus advantageously configured for the regulation, in each activated luminous region 20, of the mean value of the electric output current, as a function of the value of an element of measuring data Ism delivered by the measuring component 34, and the setpoint 46A, 46B, 46C for the mean current.

The measuring component 34 comprises, for example, a resistor 48, connected in series with the light source 13, and a signal amplification module 50 which is designed to amplify the voltage value tapped by the resistor 48.

In an unrepresented form of embodiment, the control system may be integrated, i.e. fitted to the light source. In this case, the control unit can further comprise a central processing unit, coupled to a memory in which a computer program is stored, incorporating instructions which permit the process to execute steps for the generation of signals which permit the control of the light source. The control unit may be an integrated circuit, for example an ASIC ("Application-Specific Integrated Circuit") or an ASSP ("Application-Specific Standard Product").

Figure 4:
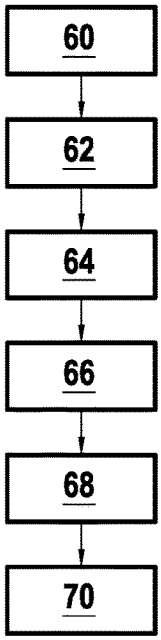
FIG. 4 shows an organigram representing the method for controlling an electric current according to the invention, deployed by the control system according to FIG. 1.

The method for controlling an electric current according to the invention, deployed by the control system 16, is described hereinafter with reference to FIG. 4.

During an initial step 60, the control system 16 receives a command signal for the activation of a first light-emitting region 20A; 20D of the light source 13. The connection device 32 then receives a corresponding activation command signal 44, and consequently activates the first light-emitting region 20A; 20D.

During the following step 62, the control component 30 regulates the mean value of the electric output voltage U1 which it delivers to the light source 13, as a function of a first setpoint 46A for the mean current. A first value of a first luminous flux is thus obtained for the light source 13. This first luminous flux corresponds to the flux emitted by the first light-emitting region 20A; 20D. According to the preferred exemplary embodiment illustrated in FIG. 1, the chopper constituting the control component 30 regulates the mean value of the electric current which it delivers to the light source 13, by modifying the duty cycle for the application of the electric input voltage $U_0$ to the terminals of the first luminous region 20A; 20D. However, during this control stage 62, the duty cycle, modified by the chopper, remains at a value in excess of 5%.

In the preferred exemplary embodiment according to which the control system 16 further comprises a measuring component 34, the control step 62 comprises a first sub-step for the measurement, by the measuring component 34, of the mean current received by the light source 13; and a second sub-step for the delivery to the control component 30, by the measuring component 34, of an element of measuring data Ism for said mean current. The chopper constituting the control component then regulates the mean value of the electric output current as a function of the value of the measuring data Ism for the mean current delivered by the measuring component 34, and the first setpoint 46A for the mean current.

During a subsequent step 64, the control system 16 receives a command signal for the activation of a second light-emitting region 20B; 20E of the light source 13. The connection device 32 then receives a corresponding activation command signal 44, and consequently activates the second light-emitting region 20B; 20E.

During a subsequent step 66, the control component 30 regulates the mean value of the electric output voltage U1 which it delivers to the light source 13, as a function of a second setpoint 46B for the mean current. A second value of a second luminous flux is thus obtained for the light source 13. This second luminous flux corresponds to the flux emitted by at least the second light-emitting region 20B; 20E. In practice, according to a first exemplary deployment of the method, the second luminous flux corresponds to the flux emitted by the first light-emitting region 20A; 20D and by the second light-emitting region 20B; 20E. As a variant, the second luminous flux corresponds exclusively to the flux emitted by the second light-emitting region 20B; 20E. In this case, the method comprises, prior to step 66, an additional step for the deactivation of the first light-emitting region 20A; 20D by the connection device 32. According to the preferred exemplary embodiment illustrated in FIG. 1, the chopper constituting the control component 30 regulates the mean value of the electric current which it delivers to the light source 13, by modifying the duty cycle for the application of the electric input voltage $U_0$ to the terminals of at least the second luminous region 20B; 20E. However, during this control step 66, the duty cycle, modified by the chopper, remains at a value in excess of 5%.

Preferably, during the control step 66, the control component 30 regulates the mean value of the electric output voltage U1 which it delivers to the light source 13, such that the ratio between the second value of the second luminous flux obtained upon the completion of this step 66 and the first value of the first luminous flux obtained upon the completion of the control step 64 is equal to or greater than 100, and preferably lies between 100 and 1,000. In order to obtain a ratio value equal to 1,000, it is possible, for example, to regulate the duty cycle to a value of 5%, and to vary the first and second concentric light-emitting regions such that the ratio between the surface areas of these regions and/or between the densities of electroluminescent rods in these regions is equal to 50.

Preferably, the method further comprises a subsequent step during which the control system 16 receives a command signal for the activation of a third light-emitting region 20C; 20F of the light source 13. The connection device 32 then receives a corresponding activation command signal 44, and consequently activates the third light-emitting region 20C; 20F.

Further preferably, during a subsequent step 70, the control component 30 regulates the mean value of the electric output voltage U1 which it delivers to the light source 13, as a function of a third setpoint 46C for the mean current. A third value of a third luminous flux is thus obtained for the light source 13. This third luminous flux corresponds to the flux emitted by at least the third light-emitting region 20C; 20F. In practice, according to a first exemplary deployment of the method, the third luminous flux corresponds to the flux emitted by the first light-emitting region 20A; 20D, by the second light-emitting region 20B; 20E and by the third light-emitting region 20C; 20F. As a variant, the third luminous flux corresponds to the flux emitted by one of the first or second light-emitting regions 20A, 20B; 20D, 20E and by the third light-emitting region 20C; 20F, or exclusively to the flux emitted by the third light-emitting region 20C; 20F. In this case, the method comprises, prior to step 70, an additional step for the deactivation of the first light-emitting region 20A; 20D and/or the second light-emitting region 20B; 20E by the connection device 32. According to the preferred exemplary embodiment illustrated in FIG. 1, the chopper constituting the control component 30 regulates the mean value of the electric current which it delivers to the light source 13, by modifying the duty cycle for the application of the electric input voltage $U_0$ to the terminals of at least the third luminous region 20C; 20F. However, during this control step 70, the duty cycle, modified by the chopper, remains at a value in excess of 5%.

Preferably, during the control step 70, the control component 30 regulates the mean value of the electric output voltage U1 which it delivers to the light source 13, such that the ratio between the third value of the third luminous flux obtained upon the completion of this step 70 and the second value of the second luminous flux obtained upon the completion of the control step 66 is equal to or greater than 4, and preferably lies between 4 and 100; and such that the ratio between the second value of the second luminous flux obtained upon the completion of the control step 66 and the first value of the first luminous flux obtained upon the completion of the control step 64 is equal to or greater than 3, and preferably lies between 3 and 30.

The control executed by the chopper which constitutes the control component 30 during the control steps 62, 66, 70 is, for example, a control of the pulse-width modulation type.

Figure 5:
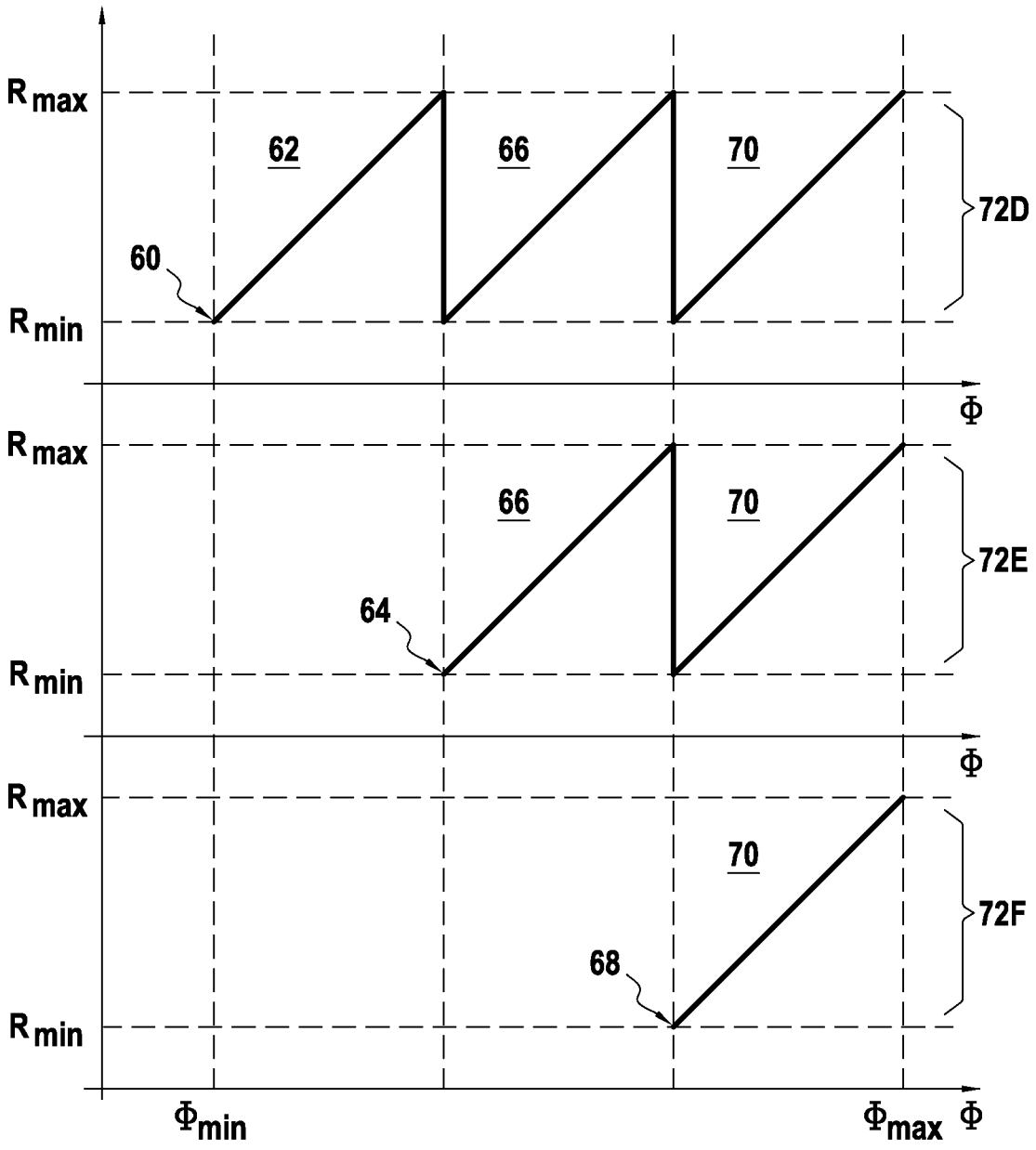
FIG. 5 shows a series of three diagrams, each of which represents the development of a duty cycle for the application of an electric input voltage to the terminals of a luminous region of the light source, as represented in FIG. 3, as a function of the total luminous flux emitted by the light source.

FIG. 5 shows an example of the control of the duty cycle for the application of the electric input voltage $U_0$, illustrating steps 60 to 70 of the method for controlling a current described above, for a light source 13 according to the particular exemplary embodiment represented in FIG. 3. More specifically, FIG. 5 is a series of three diagrams 72D, 72E, 72F, each of which represents the movement in the duty cycle R for the application of the electric input voltage $U_0$ at the terminals of one of the light-emitting regions 20D, 20E, 20F respectively, as a function of the total luminous flux Φ emitted by the light source 13. It is assumed, for example, that the maximum luminous flux emitted by the third light-emitting region 20F is greater than the maximum luminous flux emitted by the second light-emitting region 20E which, in turn, is greater than the maximum luminous flux emitted by the first light-emitting region 20D.

Initially, the total luminous flux Φ emitted by the light source 13 assumes, for example, a minimum value $\Phi_{min}$.

During the initial step 60, the connection device 32 activates the first light-emitting region 20D, as illustrated in diagram 72D. The duty cycle R for the application of the electric input voltage $U_0$ to the terminals of the first luminous region 20D assumes, for example, a minimum value $R_{min}$.

During the subsequent step 62, the control component 30 regulates the mean value of the electric output voltage U1 which it delivers to the light source 13, by modifying the duty cycle R for the application of the electric input voltage $U_0$ to the terminals of the first luminous region 20D. This regulation is executed by a progressive increase in the duty cycle R from the minimum value $R_{min}$ to a maximum value $R_{max}$, as illustrated in diagram 72D. The value $R_{min}$ is, for example, substantially equal to 5%, and the value $R_{max}$ is, for example, substantially equal to 100%.

During the subsequent step 64, the connection device 32 activates the second light-emitting region 20E, as illustrated in diagram 72E. The duty cycle R for the application of the electric input voltage $U_0$ to the terminals of the second luminous region 20E assumes, for example, a minimum value $R_{min}$. During this step 64, in order to ensure the continuity of the total luminous flux Φ emitted by the light source 13, the duty cycle R for the application of the electric input voltage $U_0$ to the terminals of the first luminous region 20D switches from its maximum value $R_{max}$ towards its minimum value $R_{min}$. In order to achieve this continuity of the total luminous flux, the following condition must be confirmed:

$$(R_{max}-R_{min})\cdot\Phi_{min\ 20D}=R_{min}\cdot\Phi_{min\ 20E}; \quad (1)$$

where $\Phi_{min\ 20D}$, and respectively $\Phi_{min\ 20E}$, is the value of the luminous flux emitted by the first luminous region 20D, and respectively by the second luminous region 20E, where the duty cycle R assumes its minimum value $R_{min}$.

During the subsequent step 66, the control component 30 regulates the mean value of the electric output voltage U1 which it delivers to the light source 13, by modifying the duty cycle R for the application of the electric input voltage $U_0$ to the terminals of the first and second luminous regions 20D, 20E. This regulation is executed by a progressive increase in the duty cycle R from the minimum value $R_{min}$ to the maximum value $R_{max}$, as illustrated in diagrams 72D, 72E. As an unrepresented variant, in order to increase the value of the total luminous flux Φ emitted by the light source 13, it is possible to increase only the value of the duty cycle R at the terminals of one of the luminous regions 20D, 20E, and to maintain the duty cycle at the terminals of the other luminous region 20D, 20E at a constant value. This produces a plateau, rather than a positive ramp, on the diagram corresponding to the latter luminous region 20D, 20E.

During the subsequent step 68, the connection device 32 activates the third light-emitting region 20F, as illustrated in diagram 72F. The duty cycle R for the application of the electric input voltage $U_0$ to the terminals of the third luminous region 20F assumes, for example, a minimum value $R_{min}$. During this step 68, in order to ensure the continuity of the total luminous flux Φ emitted by the light source 13, the duty cycle R for the application of the electric input voltage $U_0$ to the terminals of the first luminous region 20D and the duty cycle R for the application of the electric input voltage $U_0$ to the terminals of the second luminous region 20E are respectively switched from their maximum value $R_{max}$ towards their minimum value $R_{min}$. In order to achieve this continuity of the total luminous flux, the following condition must be confirmed:

$$(R_{max}-R_{min})\cdot((\Phi_{min\ 20D}+(\Phi_{min\ 20E})=R_{min}\cdot(\Phi_{min\ 20F}; \quad (2)$$

where $\Phi_{min\ 20D}$, $\Phi_{min\ 20E}$, and respectively $\Phi_{min\ 20F}$ is the value of the luminous flux emitted by the first luminous region 20D, by the second luminous region 20E, and respectively by the third luminous region 20F, where the duty cycle R assumes its minimum value $R_{min}$.

During the final step 70, the control component 30 regulates the mean value of the electric output voltage U1 which it delivers to the light source 13, by modifying the duty cycle R for the application of the electric input voltage $U_0$ to the terminals of the first, second and third luminous regions 20D, 20E, 20F. This regulation is executed by a progressive increase in the duty cycle R from the minimum value $R_{min}$ to the maximum value $R_{max}$, as illustrated in the diagrams 72D, 72E, 70F. Upon the completion of this final step 70, the total luminous flux Φ emitted by the light source 13 achieves a maximum value $\Phi_{max}$.

More generally, a principle for the control of the duty cycle which is identical or similar to that described above can be deployed, in the event that the light source 13 defines, on its substrate, a number of light-emitting regions equal to or greater than two. The same principle for the switchover of the duty cycle is then deployed, in order to ensure the continuity of the total luminous flux emitted by the light source 13 at the time of activation of further luminous regions.

In a further unrepresented form of embodiment, the values of $R_{min}$ and $R_{max}$ may differ from one region of the source to another. They may also differ, in a given region, from one step of illumination to another. The duty cycle $R_{max}$ is advantageously 100%, specifically for the achievement of $\Phi_{max}$.

The invention is described heretofore by way of an example. It is understood that a person skilled in the art will be capable of executing different variants of embodiment of the invention, without departing from the scope of the invention. Specifically, although the invention is described with reference to a lighting unit in a lighting device of a vehicle, it can be applied more generally to any lighting unit comprising a semiconductor light source which defines, on its substrate, at least two distinct light-emitting regions.

The invention claimed is:

1. A method for controlling an electric current within a semiconductor light source, the light source comprising a substrate, wherein the light source defines, on its substrate, at least two distinct light-emitting regions, wherein the method is deployed by a system for controlling the electric current within the light source, the control system comprising a control component for the mean value of an electrical variable relating to the electric current received by the light source, wherein the control component is designed to be connected to an electric current or an electric voltage input source, specifically for a direct current or direct voltage input, the control system further comprising a device for the connection of the light source to the control component, wherein the connection device is associated with distinct light-emitting regions of the light source, and is designed to execute the selective activation of the light-emitting regions, wherein the method comprises the following steps:

activating a first luminous region of the light source, regulating, by means of the control component, the mean value of the electrical variable relating to the electric current received by the light source as a function of a first setpoint for the mean current, electric voltage or electric power, so as to obtain a first value of a first luminous flux for the light source, wherein the first luminous flux corresponds to the flux emitted by the first luminous region, activating at least a second luminous region of the light source, regulating, by means of the control component, the mean value of the electrical variable relating to the electric current received by the light source as a function of a second setpoint for the mean current, electric voltage or electric power, so as to obtain a second value of a second luminous flux for the light source, wherein the second luminous flux corresponds to the flux emitted by at least the second luminous region and a dynamic flux of the light source defined by a ratio between extreme flux values of the light source is equal to or greater than 100.

2. The method as claimed in claim 1, wherein the control component is a chopper, and the control executed by the chopper is control of the pulse-width modulation type.

3. The method as claimed in claim 1, wherein the at least two light-emitting regions are concentric regions.

4. The method as claimed in claim 3, wherein the light source defines, on its substrate, three distinct light-emitting regions, wherein a first light-emitting region is surrounded by a second light-emitting region, the second light-emitting region is surrounded by a third light-emitting region, and the method further comprises a step for activating the third luminous region, and a step for regulating, by means of the control component, the mean value of the electrical variable relating to the electric current received by the light source as a function of a third setpoint for the mean current, electric voltage or electric power, so as to obtain a third value for a third luminous flux of the light source, wherein the third luminous flux corresponds to the flux emitted by at least the third luminous region.

5. The method as claimed in claim 4, wherein, during the control steps, the control component regulates the mean value of the electrical variable relating to the electric current received by the light source, such that the ratio between the second value of the second luminous flux obtained at the end of the second control step and the first value of the first luminous flux obtained at the end of the first control step is equal to or greater than 3, and preferably lies between 3 and 30; and such that the ratio between the third value of the third luminous flux obtained at the end of the third control step and the second value of the second luminous flux obtained at the end of the second control step is equal to or greater than 4, and preferably lies between 4 and 100.

6. The method as claimed in claim 1, wherein the control system further comprises a measuring component for a representative electrical variable of a current flowing in the light source, wherein the control component is connected to the measuring component, wherein the method further comprises a step for measuring a representative electrical variable of the electric current flowing in the light source, and a step for the delivery of at least one element of measuring data for the electrical variable, and wherein each step for the control of the mean value of the electrical variable relating to the electric current received by the light source constitutes a regulation of the mean value, executed as a function of the measuring data and a first, or respectively a second, setpoint for the mean current, electric voltage or electric power.

7. The method as claimed in claim 2, wherein the at least two light-emitting regions are concentric regions.

8. The method as claimed in claim 2, wherein the first value of the first luminous flux obtained for the light source and the second value of the second luminous flux obtained for the light source are such that the ratio between the second value of the second luminous flux and the first value of the first luminous flux is equal to or greater than 100, and preferably lies between 100 and 1,000.

9. The method as claimed in claim 2, wherein the control system further comprises a measuring component for a representative electrical variable of a current flowing in the light source, wherein the control component is connected to the measuring component, wherein the method further comprises a step for measuring a representative electrical variable of the electric current flowing in the light source, and a step for the delivery of at least one element of measuring data for the electrical variable, and wherein each step for the control of the mean value of the electrical variable relating to the electric current received by the light source constitutes a regulation of the mean value, executed as a function of the measuring data and a first, or respectively a second, setpoint for the mean current, electric voltage or electric power.

10. A method for controlling an electric current within a semiconductor light source, the light source comprising a substrate, wherein the light source defines, on its substrate, at least two distinct light-emitting regions, wherein the method is deployed by a system for controlling the electric current within the light source, the control system comprising a control component for the mean value of an electrical variable relating to the electric current received by the light source, wherein the control component is designed to be connected to an electric current or an electric voltage input source, specifically for a direct current or direct voltage input, the control system further comprising a device for the connection of the light source to the control component, wherein the connection device is associated with distinct light-emitting regions of the light source, and is designed to execute the selective activation of the light-emitting regions, wherein the method comprises the following steps:

activating a first luminous region of the light source, regulating, by means of the control component, the mean value of the electrical variable relating to the electric current received by the light source as a function of a first setpoint for the mean current, electric voltage or electric power, so as to obtain a first value of a first luminous flux for the light source, wherein the first luminous flux corresponds to the flux emitted by the first luminous region, activating at least a second luminous region of the light source, regulating, by means of the control component, the mean value of the electrical variable relating to the electric current received by the light source as a function of a second setpoint for the mean current, electric voltage or electric power, so as to obtain a second value of a second luminous flux for the light source, wherein the second luminous flux corresponds to the flux emitted by at least the second luminous region, wherein the first value of the first luminous flux obtained for the light source and the second value of the second luminous flux obtained for the light source are such that the ratio between the second value of the second luminous flux and the first value of the first luminous flux is equal to or greater than 100, and preferably lies between 100 and 1,000.

11. A system for controlling an electric current within a semiconductor light source, the light source comprising a substrate, wherein the light source defines, on its substrate, at least two distinct light-emitting regions, the system being designed for controlling an electric current, wherein the system comprises a control component for the mean value of an electrical variable relating to the electric current received by the light source, and a device for the connection of the light source to the control component, wherein the connection device is associated with distinct light-emitting regions of the light source, and is designed for the selective activation of the light-emitting regions; the control component is designed to be connected to an electric current or an electric voltage input source, specifically for a direct current or direct voltage input, and is configured to regulate, for each luminous region activated, the mean value of the electrical variable relating to the electric current received by the light source as a function of a setpoint for the mean current, electric voltage or electric power associated with the activation such that a dynamic flux of the light source defined by a ratio between extreme flux values of the light source is equal to or greater than 100.

12. A lighting unit comprising a semiconductor light source and a system for controlling an electric current within the light source, wherein the light source comprises a substrate and defines, on its substrate, at least two distinct light-emitting regions, in which the system for controlling the electric current is as claimed in claim 11.

13. The lighting unit as claimed in claim 12, wherein the light source further comprises a plurality of electroluminescent rods, extending from the substrate.

14. The lighting unit as claimed in claim 13, wherein the electroluminescent rods are divided into a plurality of separate groups of rods, wherein each group of rods corresponds to all or part of one of the light-emitting regions.

15. The lighting unit as claimed in claim 12, wherein the light source comprises a plurality of photoemitter elements, wherein the photoemitter elements are divided into a plurality of separate groups of photoemitter elements, wherein each group of photoemitter elements corresponds to one of the luminous regions, wherein the photoemitter elements in the groups corresponding to the at least two light-emitting regions are interlaced such that the groups of photoemitter elements constitute interlaced matrices of discrete photoemitter elements.

16. The lighting unit as claimed in claim 12, wherein the at least two light-emitting regions are concentric regions.

17. The lighting unit as claimed in claim 16, wherein the light source defines, on its substrate, a first light-emitting region, and a second light-emitting region, which is distinct from the first region and which surrounds the first region, wherein the surface area of the second light-emitting region is greater than that of the first light-emitting region, for example such that the ratio between the surface area thereof and the surface area of the first light-emitting region is equal to or greater than 9, and is preferably equal to or greater than 10.

18. The lighting unit as claimed in claim 16, wherein the light source defines, on its substrate, a first light-emitting region, and a second light-emitting region, which is distinct from the first region and which surrounds the first region, wherein the density of the electroluminescent rods in the group corresponding to the second light-emitting region is greater than that of the group corresponding to the first light-emitting region, for example such that the ratio between the density thereof and the density of the electroluminescent rods in the group corresponding to the first light-emitting region is equal to or greater than 12, and is preferably equal to or greater than 10.

19. A lighting device of a vehicle comprising at least one lighting unit, wherein the lighting unit is compliant with claim 12.

20. The lighting unit as claimed in claim 13, wherein the light source comprises a plurality of photoemitter elements, wherein the photoemitter elements are divided into a plurality of separate groups of photoemitter elements, wherein each group of photoemitter elements corresponds to one of the luminous regions, wherein the photoemitter elements in the groups corresponding to the at least two light-emitting regions are interlaced such that the groups of photoemitter elements constitute interlaced matrices of discrete photoemitter elements.

* * * * *